United States Patent [19]

Gitlin et al.

[11] 4,350,240

[45] Sep. 21, 1982

[54] COIN SLIDE WITH INTERCHANGEABLE CORES

[75] Inventors: Harvey S. Gitlin, Ambler; John J. Duffy, Glenside, both of Pa.

[73] Assignee: Equipment Systems & Devices, Inc., Philadelphia, Pa.

[21] Appl. No.: 152,684

[22] Filed: May 23, 1980

[51] Int. Cl.[3] ..... G07F 5/08

[52] U.S. Cl. ..... 194/92

[58] Field of Search ..... 194/1 E, 1 G, 57, 58, 194/79, 80, DIG. 2, 54–57, 69, 92, 93

[56] References Cited

U.S. PATENT DOCUMENTS

| | | | |
|---|---|---|---|
| 2,840,215 | 6/1958 | Hensley, Jr. | 194/92 |
| 3,602,352 | 8/1971 | Robinson | 194/92 |
| 3,712,440 | 1/1973 | Greenwald | 194/55 |
| 3,978,960 | 9/1976 | Mellinger et al. | 194/55 |
| 4,098,385 | 7/1978 | NcNally | 194/55 |
| 4,221,285 | 9/1980 | Greenwald et al. | 194/1 G |

*Primary Examiner*—Stanley H. Tollberg

*Attorney, Agent, or Firm*—Weiser, Stapler & Spivak

[57] ABSTRACT

The coin slide includes a fixed body with an integral flange and an integral handle and slide plate which is reciprocal on the body and through the flange. The handle is provided with a plurality of elongated openings within which are fitted interchangeable functional or nonfunctional cores. The functional cores are sized to receive coins of predetermined denomination and can be made to accommodate any size coin, even foreign coins. An interchangeable bridge includes downwardly exposed ramps or cams to accept or check coins of predetermined denomination. The interchangeable cores and interchangeable bridge are utilized to quickly and easily adjust to any desired price which can be computed when using from one to five coins.

30 Claims, 21 Drawing Figures

18
134
136
136
136
26
20
38'
24
14
96
94
98
50
108
82
36
52
42
40
44
58
38'
90
20
106
108
36
72
38
24
64
82
46
42
66
44
58
114
90
20
114
34
24
38
18
46
42
120
44
58

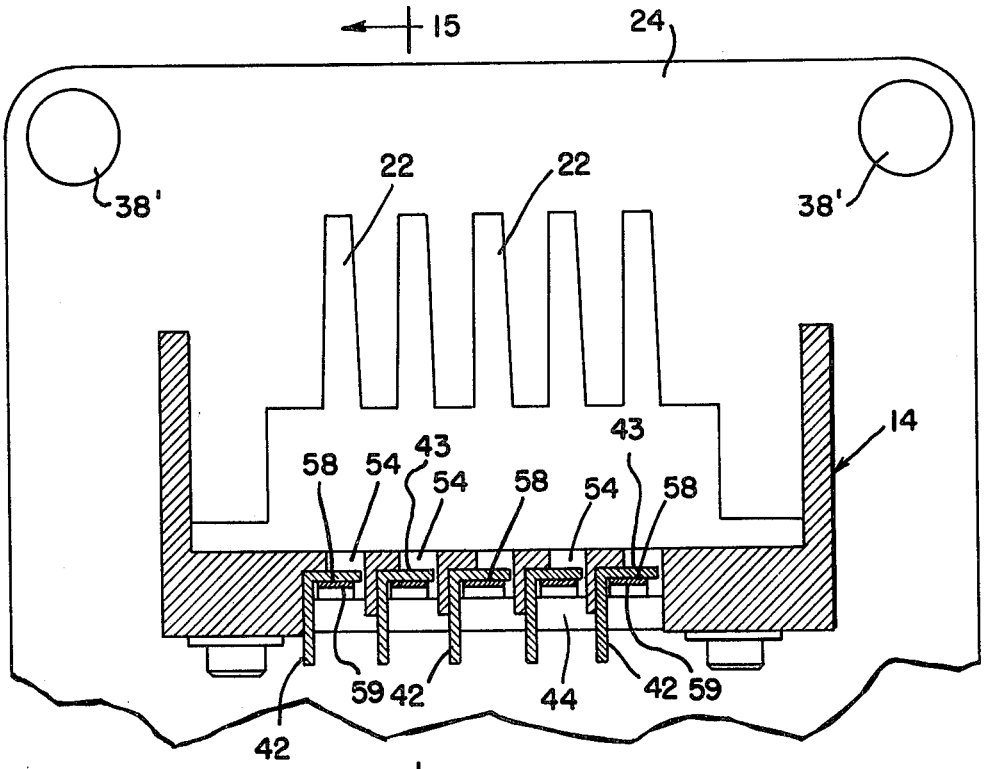
FIG. 14
FIG. 15
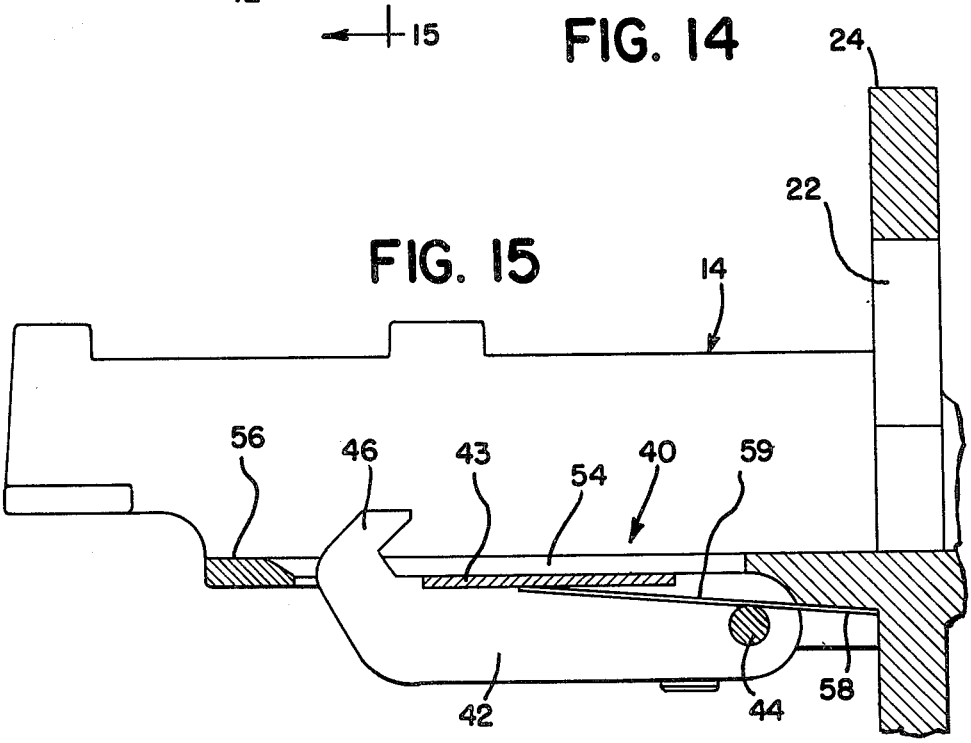

COIN SLIDE WITH INTERCHANGEABLE CORES

BACKGROUND OF THE INVENTION

The present invention relates generally to the vending machine industry, and more particularly is directed to a coin slide suitable for use with machines which are activated by a mechanical coin slide, for example coin operated laundry machines.

Coin slides have long been utilized in the vending machine industry to accept, check and receive coins of the required denomination and amount to pay for a specified vending operation. Early in the industry, it was common to employ a coin slide having but a single opening to receive therein a single coin, for example a dime or a quarter. Such an opening was usually horizontally aligned and the coin was accepted in horizontal orientation.

As prices began to rise and as machines became more sophisticated and more costly, it then became necessary to design and provide coin slides capable of functioning with more than one coin. It then became a common practice to employ a single coin slide to accept multiple coins, for example two, three or four coins. In these prior art devices also, it was the usual practice to design the coin slide with coin receiving openings in horizontal alignment. It will be appreciated as the number of coins increased, the size of the slide handle correspondingly also increased to provide for the number of coins thereon in side by side, horizontal arrangement.

More recently, coin slides have been developed which are suitable to accept multiple coins in vertical orientation. Such devices were generally designated as vertical coin slides and the handle was equipped with coin receiving slots of suitable size to receive therein coins of predetermined denomination. One of the drawbacks of the currently available vertical coin slides is the fact that the coin receiving slots were milled or otherwise formed to receive a specified coin or coins therewithin. When it was desired to change the vending price for an individual machine, it was necessary to provide a completely new handle having coin receiving slots of the proper sizes.

Additionally, in those instances wherein vertical coin slides were provided with, for example, four coin receiving slots and for the desired price, only three of the slots were to be employed in the coin accepting operation, it then became necessary to blank the unused slot or opening. This usually required disassembly and reassembly of the mechanism, all of which took considerable time, effort and skill.

Further, coin slides, by their very nature, must be ruggedly constructed and must be designed to function reliably and effectively under severe conditions of use. The mechanism must be able to differentiate between real coins and slugs, between proper coins and blanking devices sometimes introduced by vandals or thieves. As an additional consideration, coin slides also must be effective in accepting multiple coins of proper denomination and in rejecting coins of improper denomination. Such important and complicated functions often led to the development of coin slides that were unusually complex in construction, quite expensive in fabrication and unusually difficult to repair or adjust.

SUMMARY OF THE INVENTION

This invention relates generally to the field of coin slides, and more particularly, is directed to a vertical coin slide of the type including interchangeable coin accepting apparatus designed to easily and speedily change the vending operation price.

The coin slide of the present invention includes a body having a flange suitable to accept coins in vertical orientation. An integral handle and slide plate is provided with a plurality of elongated slots and is slidably arranged relative to the body beneath a bridge. The coin slots are all of identical size and are suitably arranged to receive therein an interchangeable core, each functional core being provided with a coin receiving opening of a specified denomination. The interchangeable functional cores include a forward locking edge which is engageable upon a rearwardly positioned hook of the type that is pivotally carried by the body. In the absence of a properly sized coin, the core locking edge will engage the hook to thereby prevent vending operation of the machine.

It is an important feature of the invention to provide interchangeable cores that are both functional and nonfunctional whereby one or more of the coin receiving openings in the handle can be effectively blanked by inserting a nonfunctional core. It is important to note that a nonfunctional core is not equipped with a locking edge and accordingly, there can be no engagement with the interior, aligned hook. Thus, all blanking and price changing is done directly at the handle by selecting and installing the proper arrangement of functional and nonfunctional cores. Accordingly, there is no need to make any interior adjustments or replacements in order to change the vending price, either upwardly or downwardly. The coin accepting slots in the handle of the present invention are completely interchangeable through use of the interchangeable cores and the coin slide can be made to accept any combination of coins of any denomination, even foreign coins. The nonfunctional cores present a completely blank, filled condition to thereby discourage would-be thieves and vandals in this area.

It is noteworthy that the interchangeable cores are secured within the coin slots in an extremely simple construction, for example by one or two small bolts. Accordingly, it is a feature of the invention to design the parts to that the interchangeable core bolts are accessible rearwardly of the body without the need to disassemble the entire mechanism just to change the price. Price change herein is now a relatively simple operation whereby the cores can be changed quickly and easily without major mechanical difficulties.

A bridge having specifically designed cams to accept and check specific sized coins cooperates with the arrangement of interchangeable cores to check and receive coins only of the proper denomination. The cams are positioned rearwardly of the body flange and act to press the coins individually downwardly against the levers to thereby release the hooks below the locking edges of the interchangeable cores as the slide and handle is urged rearwardly. The bridge is a four-way bilevel bridge with the cams or ramps designed to size and accept only proper coins.

An improved nesting system is built into the body to prevent acceptance of slugs. In order to accent the coin drop, each coin is provided with a separate track or slide to make sure that the levers are operational only with a functional core. Separators are provided at the levers to assure proper function under all conditions of use.

In another novel construction feature, the body is provided with a delay means to permit some of the coins to fall first and others to follow as the coin slide is rearwardly urged. In this manner, simultaneous dropping of all of the coins, for example five coins, into the coin box can be prevented to thereby prevent such a large number of coins from jamming the relatively small, existing opening into the coin box.

It is therefore an object of the present invention to provide an improved coin slide of the type set forth.

It is another object of the present invention to provide a novel vertical coin slide having coin receiving openings equipped with easily interchangeable cores to facilitate quick and easy price change.

It is another object of the present invention to provide a novel coin slide including improved coin accepting and rejecting mechanism to discourage tampering or other improper operation.

It is another object of the present invention to provide a novel coin slide that is relatively simple in design, relatively inexpensive in manufacture and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 14 is an enlarged, cross sectional view taken along line 14—14 on FIG. 10 with the bridge removed.

FIG. 15 is an enlarged, cross sectional view taken along line 15—15 of FIG. 14.

DESCRIPTION OF THE PREFERRED EMBODIMENT OF THE INVENTION

Figure 1:
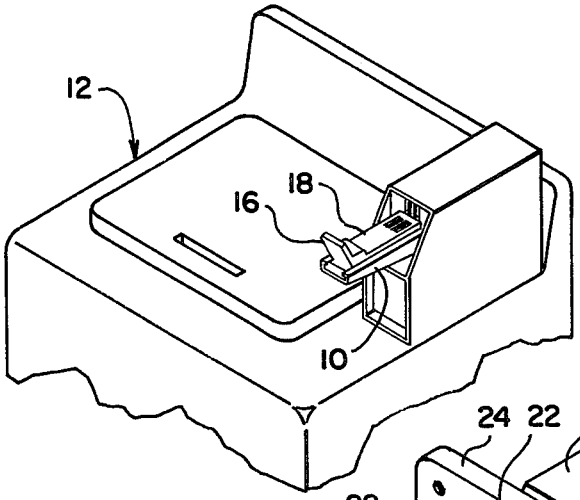
FIG. 1 is a perspective view of the coin slide of the present invention installed in a vending type washing machine.

Although specific terms are used in the following description for the sake of clarity, these terms are intended to refer only to the particular structure of the invention selected for illustration in the drawings, and are not intended to define or limit the scope of the invention.

Referring now to the drawings, the coin slide 10 of the present invention is illustrated in use in FIG. 1 in conjunction with a vending type washing machine 12. Of course, the coin slide 10 of the present invention could be used with other types of vending machines wherein it is desirable or necessary to employ a coin slide of the type having the handle 16 extending exteriorly of the machine itself.

Figure 2:
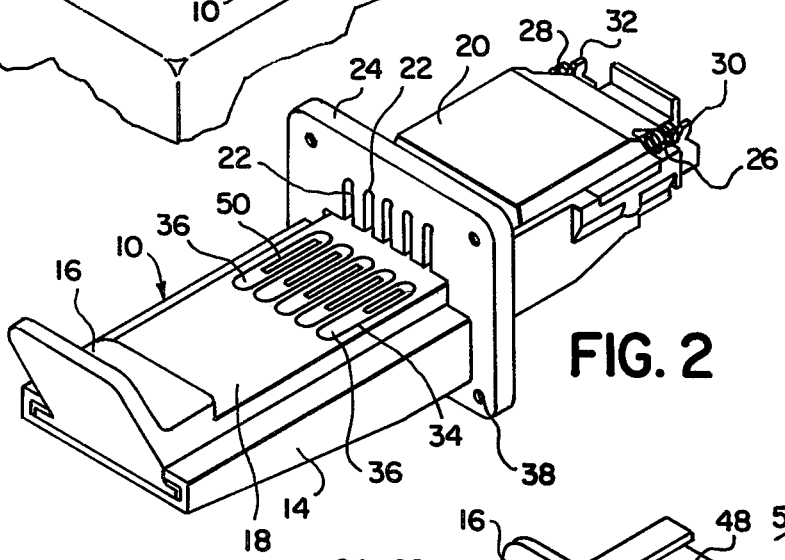
FIG. 2 is a front perspective view of the coin slide of the present invention.
Figure 3:
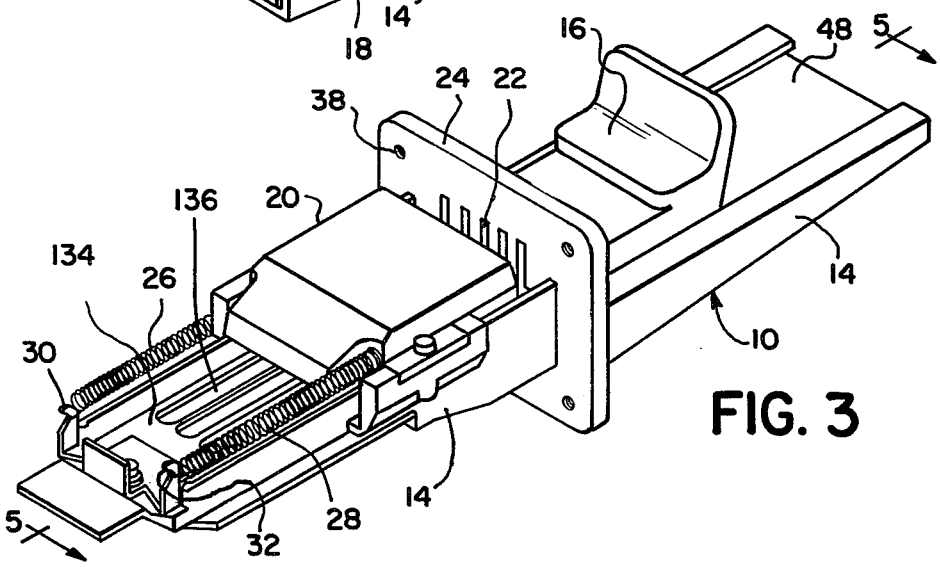
FIG. 3 is a rear perspective view of the coin slide of FIG. 2 showing the handle and slide pushed inwardly from the position of FIG. 2.
Figure 4:
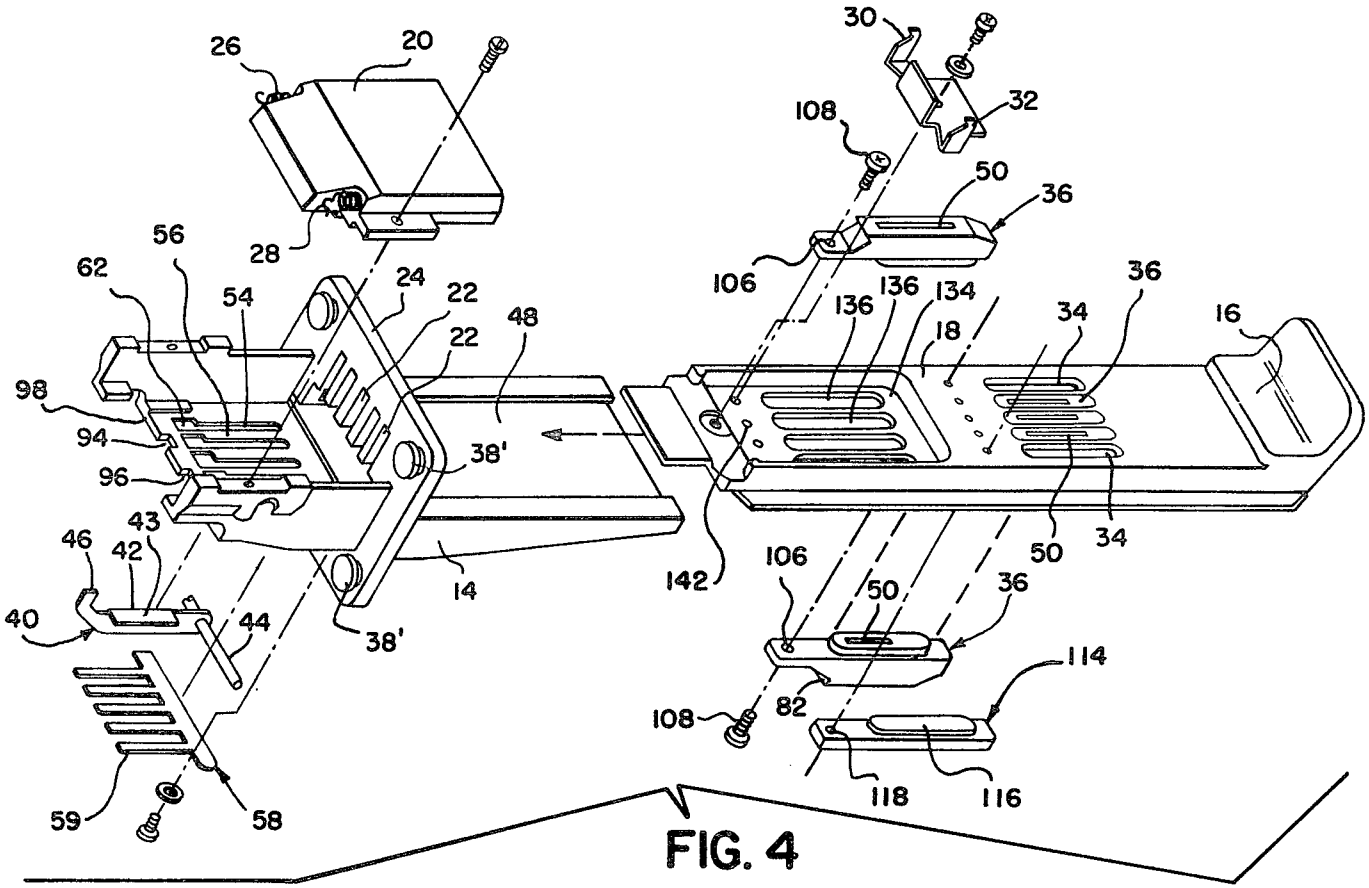
FIG. 4 is an exploded top perspective view of the coin slide.

As best seen in FIGS. 2, 3 and 4, the coin slide 10 comprises generally a body 14 including a mounting or face flange 24 for securing to a vending machine 12 in known manner. A plurality of mounting openings 38, which preferably are threaded in the usual manner are provided in the flange 24 for securing the coin slide to the vending machine in a secure, tamperproof manner, for example, by employing interiorly positioned mounting bolts 38'. The slide 18 may include a storage area or compartment 134 which is provided with a plurality of longitudinally aligned openings 136. As illustrated, one or more extra functional cores 36 or non-functional cores 138 may be removably stored in the storage area 134 by employing a small bolt 140 which can be threadedly engaged in a threaded opening 142 in known manner. As illustrated, the integral handle 16 and slide 18 are reciprocal within the slide track 48 of the body 14 through the body flange 24. The slide 18 is provided with a plurality of transversely spaced, similar, longitudinally aligned openings 34 to receive therein individual, interchangeable cores 36 in an easily replaceable manner. The cores 36 may be either functional wherein a coin accepting opening 50 is provided or the core may be nonfunctional wherein no opening 50 is provided. This feature will hereinafter be more fully described in detail.

As illustrated, the slide 18 is provided with five core receiving openings 34 and the flange 24 is equipped similarly with five coin receiving openings 22 in longitudinal alignment with the central axes of the respective interchangeable cores 36. Each functional core will be provided with a specifically sized coin receiving opening 50 of size and configuration to receive a coin of specified denomination, for example a nickel, a dime, a quarter or a dollar. The coin receiving openings 22 in the flange 24 cooperate with the coin openings 50 in the interchangeable cores 36 to provide an initial coin checking function. So long as a coin 52 can insert within the coin opening 50 in a core 36 and through the coin receiving opening 22 in the face flange 24, there will be no resistance to rearward movement of the slide 18 to start the vending cycle. As best seen in FIG. 3, a pair of operating springs 26, 28 bias between respective lugs 30, 32 which are rearwardly affixed to the slide 18 and to stationary construction within the bridge 20. The springs 26, 28 are mounted to normally bias the slide 18 to an initial, coin accepting position as illustrated in FIG. 2. When the slide 18 is urged inwardly to initiate the operation of the machine 12, the bias of the springs 26, 28 must be overcome by inwardly directed forces on the handle 16 in known manner.

A lever checking mechanism 40 is affixed to the body 14 rearwardly of the face flange 24 and includes a plurality of coin slots 54 in longitudinal alignment with the coin openings 50 in the interchangeable cores 36. A lever 42 is movable about the pivot shaft 44 below each coin slot 54 for coin checking purposes as hereinafter more fully set forth. Each lever 42 includes a rearwardly positioned hook 46 which extends upwardly above the planar top of the coin checking mechanism body 56. Each lever 42 is provided with a ledge 43 in engagement with a finger 59 of the leaf spring 58 to normally urge the associated lever upwardly to extend the hook 46 above the top surface of the body 56.

Figure 5:
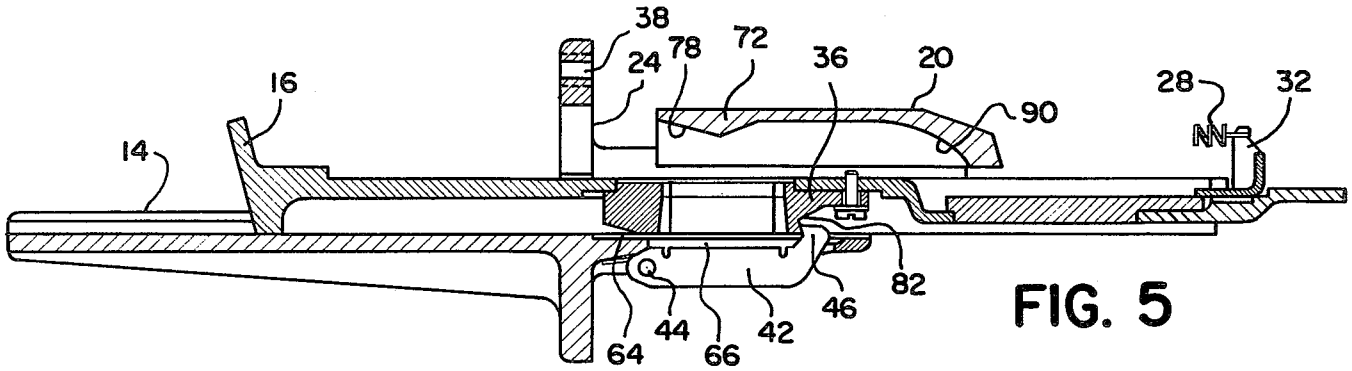
FIG. 5 is an enlarged, cross sectional view taken along line 5—5 of FIG. 3, looking in the direction of the arrows.

Referring now to FIGS. 5–11, the sequence of coin acceptance will now be described. When the proper number and denomination of coins have been inserted into the plurality of coin openings 50 as provided in the interchangeable cores 36, the handle 16 can be pushed inwardly against the bias of the springs 26, 28 until the coins pass through the openings 22 provided in the body flange 24. In each coin track rearwardly of the flange 24 is provided a first coin check or antitheft device 64 in the nature of a first drop within which proper size coins are received and monitored. Provided the coins are accepted in the first drop 64, inward movement of the slide 18 can proceed until the coin proceeds into the second drop or antitheft device 66. Optimumly, the first drop 64 is less in height than the second drop 66. In one embodiment, a first drop of 0.030 inches has been found satisfactory in combination with a second drop of 0.070 inches. At the second drop 66, the coins 52 will pass through the lever checking mechanism coin slots 54 to bear directly upon the top surfaces of the respective levers 42. See FIG. 6. It is noteworthy that the bridge 20 is provided with a plurality of laterally spaced cams or bearing surfaces 68, 70, 72, 74, 76 respectively in alignment with each of the coin openings 50 provided in the interchangeable cores 36. See FIGS. 16 and 17. As the slide 18 is rearwardly advanced, the coins 52 will engage the respective cams upon their forward, downwardly inclined surfaces 78 to force the coins downwardly within the respective coin slots 54 to bear against the plurality of pivotal levers 42. If the coin 52 is of proper size, the cams 68–76 function to urge the respective levers 42 downwardly about the pivot shaft 44 until the respective hooks 46 are urged downwardly through the hook openings 62 until the entire hook configuration is urged downwardly below the plane of the lever checking mechanism top surface 60. See FIG. 6. With the hooks 46 pushed below the top surface 60, then the respective locking edges 82 of the plurality of interchangeable cores cannot engage the hooks 46 and the slide 18 can be pushed from the position indicated in FIG. 6 toward the position indicated in FIG. 8. Of course, if there were no coin 52 positioned in a coin opening 50, then rearward movement of the slide 18 relative to the body 14 would be prevented by the engagement of the hook 46 with the locking edge 82 of the interchangeable core 36 as illustrated in FIG. 5.

Figure 6:
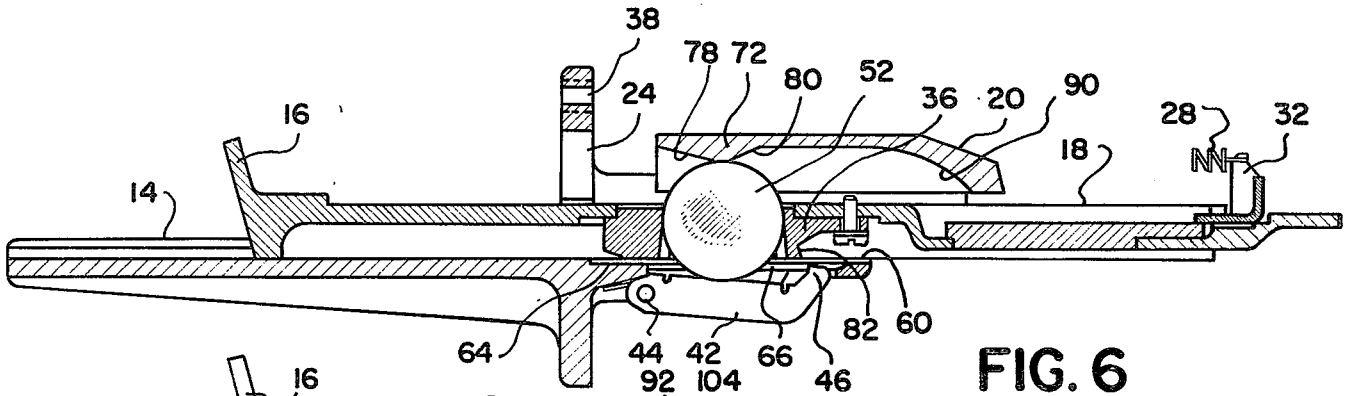
FIG. 6 is a cross sectional view similar to FIG. 5, showing a coin positioned in contact with a cam and a lever.
Figure 7:
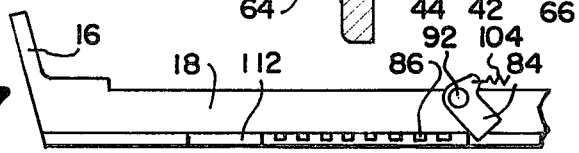
FIG. 7 is a partial, sectional view showing the position of the ratchet arm when the handle is positioned as in FIG. 6.

It is noteworthy that when the slide 18 is moved to the position illustrated in FIG. 6, the ratchet arm 84 is not yet engaged in a ratchet notch 86 and accordingly, the slide could still be withdrawn by pulling rearwardly on the handle 16. The springs 26, 28 would also tend to facilitate withdrawal of the slide at this point.

It will be noted that the downwardly inclined surface 78 of each cam 68–76 functions to press the coin 52 downwardly to depress the lever 42 about its pivot 44 until maximum depth is achieved. As the slide is rearwardly urged toward the position in FIG. 8, the coin will ride upwardly against the upward inclined surface 80 of the cams upon impetus of the lever spring 58. The upwardly inclined surface 80 provides an additional check for a possibly undersized coin as the lever starts to return to its normal, locking position.

Figure 8:
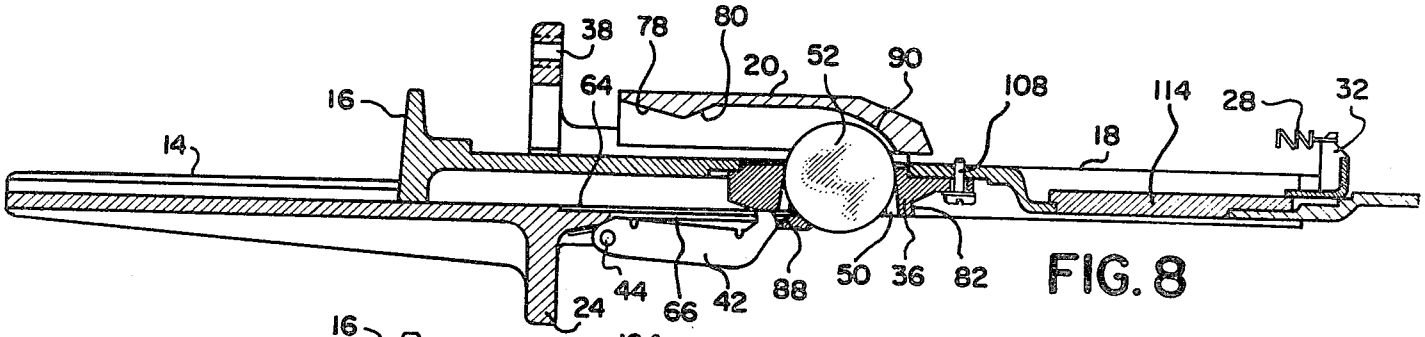
FIG. 8 is a view similar to FIG. 6 showing the handle moved to the first coin drop position.

As the slide 18 is urged to the first coin drop position of FIG. 8, the second coin drop 66 ramps upwardly at 88 to lift the coin 52 and to urge the coin against the rearward bridge cam surface 90 to the coin drop position rearwardly of the lever checking mechanism 40.

Figure 9:
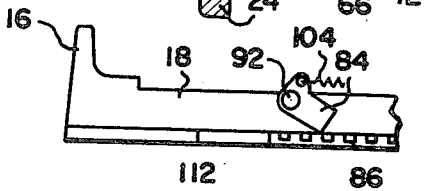
FIG. 9 is a partial, cross sectional view showing the position of the racket arm when the handle is moved to the position of FIG. 8.

With the slide 18 urged to the position of FIG. 8, the ratchet arm 84 will be rotated about its pivot 92 to the position indicated in FIG. 9 wherein the ratchet arm will be urged into engagement with one of the ratchet notches 86 to thus prevent withdrawal of the slide 18.

Figures 12, 13, 18:
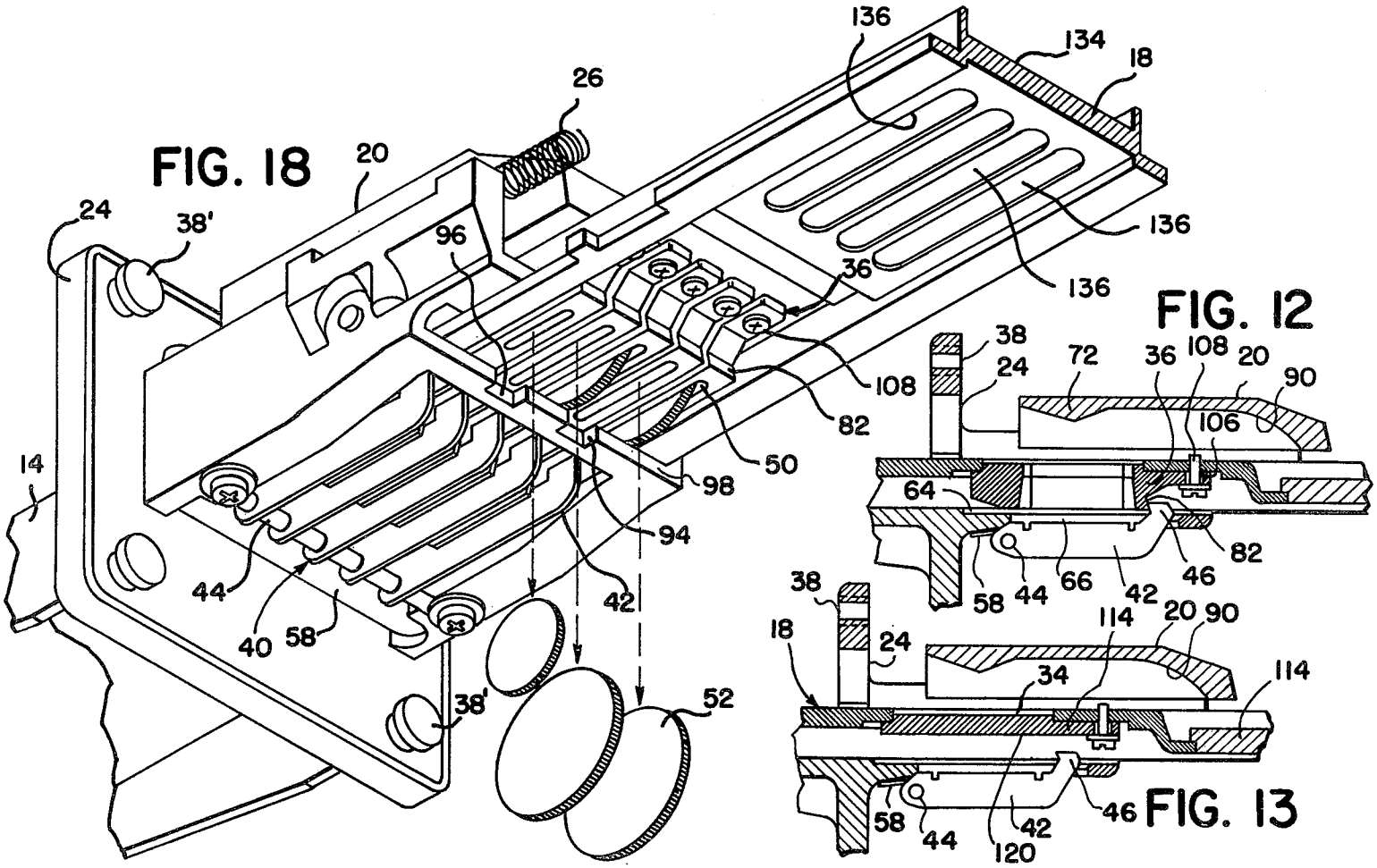
FIG. 12 is a partial, sectional view showing the interaction of a functional core and a lever.
FIG. 13 is a partial, sectional view showing the interaction of a non-functional core and a lever.
FIG. 18 is an enlarged, partial, bottom, perspective view of the mechanism in the coin dropping position.
Figure 16:
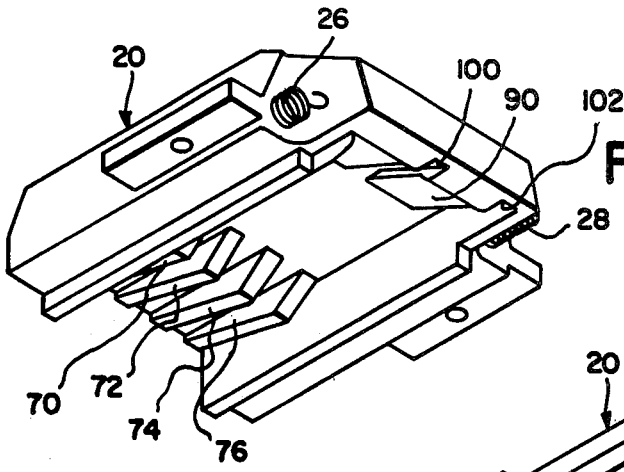
FIG. 16 is an enlarged, front, bottom, perspective view of the bridge.
Figure 17:
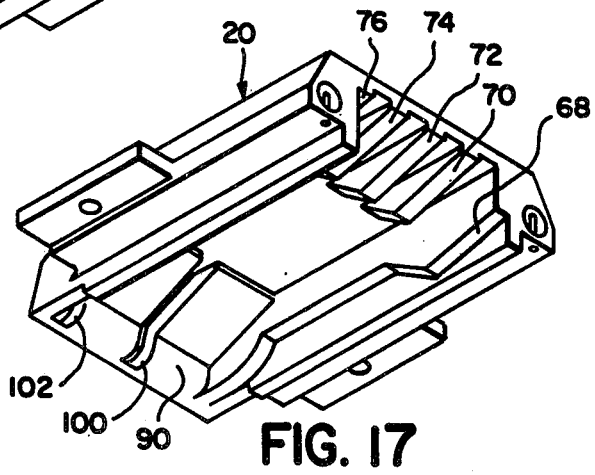
FIG. 17 is an enlarged, bottom, rear, perspective view of the bridge of FIG. 16.
Figure 19:
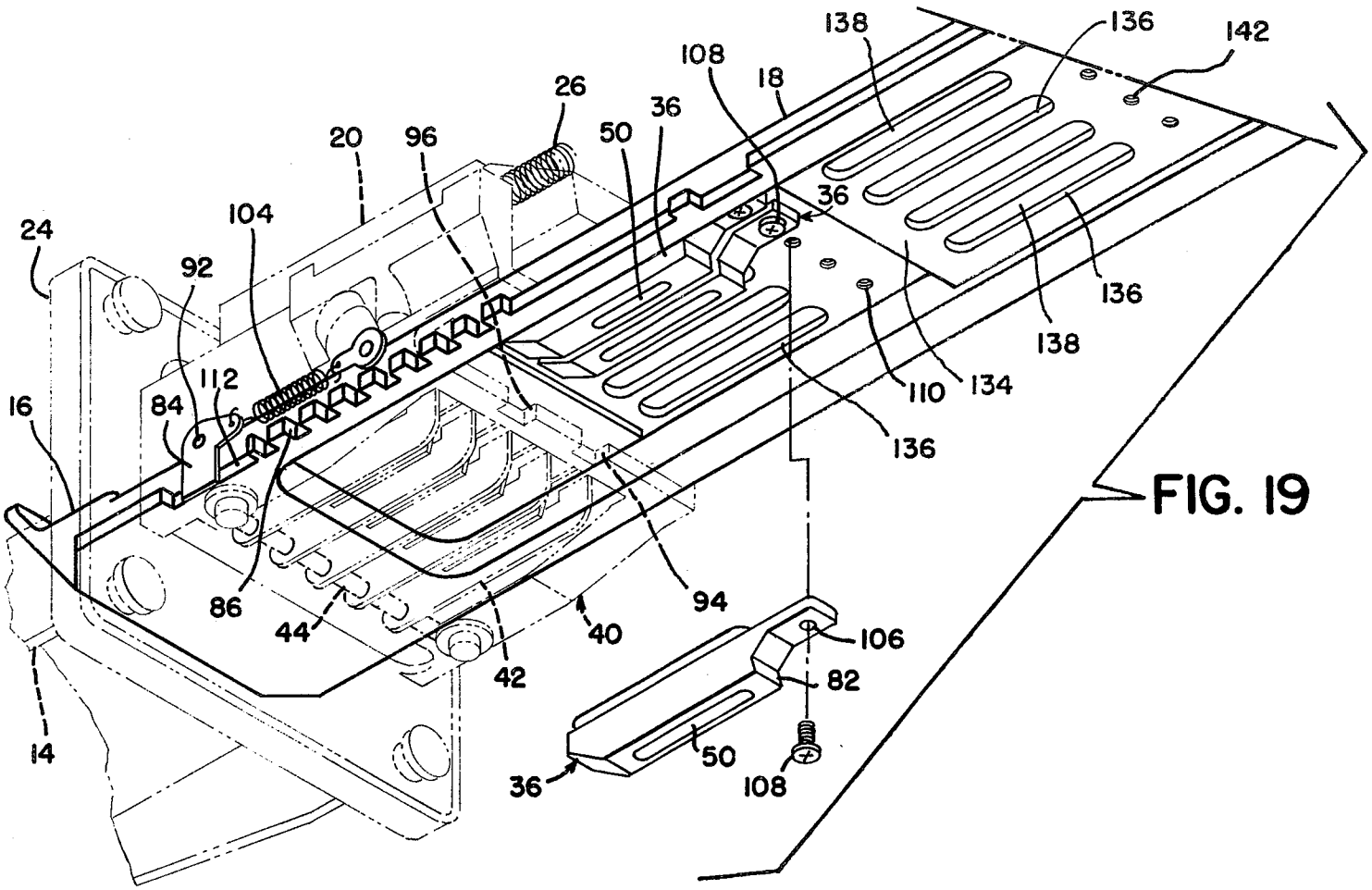
FIG. 19 is an enlarged, partial, bottom, perspective view similar to FIG. 18 showing the arrangement of parts with the slide in the core changing position.

As best seen in FIGS. 18 and 19, the body 56 of the lever checking mechanism is provided at the trailing edge 98 thereof with one or more coin drop notches 94, 96. Accordingly, as the slide 18 is urged to the position illustrated in FIG. 8, those coins 52 positioned in alignment with the notches 94, 96 will have sufficient clearance rearwardly of the trailing edge 98 of the body 56 to drop therethrough as indicated in FIG. 18. The remainder of the coins 52 will still be retained in association against the bridge 20 inasmuch as insufficient clearance is provided in the FIG. 8 position to permit passage of the coins toward the coin box (not shown). As indicated in FIGS. 16 and 17, the bridge cam surface 90 can be undercut at 100, 102 in vertical alignment over the notches 94, 96 to provide the additional clearance necessary to permit some of the coins to drop in the FIG. 8 position.

Figure 10:
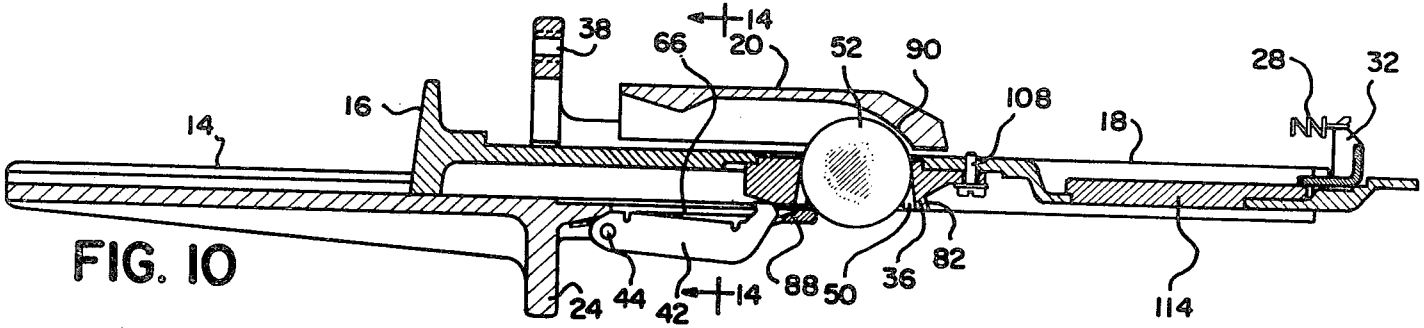
FIG. 10 is a cross sectional view similar to FIG. 6 showing the position of the handle and slide in the second coin drop position.
Figure 11:
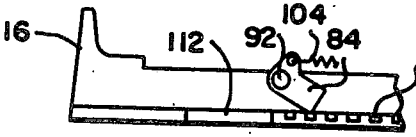
FIG. 11 is a partial, cross sectional view showing the position of the ratchet mechanism when the handle is moved to the release position of FIG. 10.

Upon additional urging of the slide 18 rearwardly to the second coin release position as illustrated in FIG. 10, the rearward bridge cam surface 90 will act to urge the remaining coins 52 downwardly into the coin box (not shown). Accordingly, by providing the notches 94, 96 in the trailing edge of the lever checking mechanism body 56 and the cooperating undercut cams 100, 102 in the rearward bridge cam surface 90, some of the coins can be allowed to drop into the cashbox ahead of other of the coins, thereby preventing any tendency of the coins to jam due to too many coins falling at the same time. As shown in FIG. 11, when the slide 18 reaches the position of FIG. 10, the ratchet arm 84 is urged about its pivot 92 by the spring 104 into engagement with one of the ratchet notches 86 to still prevent withdrawal of the slide 18 from rearward position illustrated in FIG. 10.

After all of the coins have been released as the slide 18 is pushed to the first release position of FIG. 8 through the second release position of FIG. 10, then the slide 18 can be urged fully rearwardly to the vending operation position of FIG. 19. It is noteworthy that in the full rearward position of FIG. 19, the ratchet arm 84 is pivoted into the elongated clearance notch 112 by action of its ratchet spring 104 about the ratchet pivot 92. With the ratchet arm 84 thus pulled into a neutral position, withdrawal of the slide 18 relative to the body 14 can then occur as the ratchet arm 84 will not engage upon any of the notches 86 as the slide 18 is withdrawn. It is noteworthy that the interchangeable cores 36 are exposed rearwardly of the lever checking mechanism 40 in the position illustrated in FIG. 19 and accordingly, in this position, the cores 36 may be readily interchanged without major disassembly of the unit. As indicated, each core 36 includes a mounting hole 106 through which a threaded fastener 108 can freely turn to engage the threaded opening 110 in the slide body 18. Accordingly, when it is desired to change a core 36 to provide a coin receiving opening 50 of different size, for example to change from a ten cent coin receiving size to a twenty five cent coin receiving size, all that would be required would be to threadedly disengage the fastener 108 to remove the interchangeable core 36 in place and then provide a new core 36 having the desired size coin receiving opening 50 therein. The interchangeable core is positioned within the slide body opening 34 and the fastener 108 can then be readily reengaged within the threaded opening 110 to quickly and easily provide for a desired price change.

Figure 20:
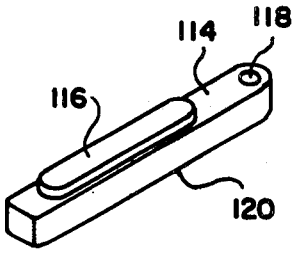
FIG. 20 is a perspective view of a non-functional core.

Referring now to FIG. 20, there is illustrated a nonfunctional core 114 including an integral upward projection 116 of size and dimensions to completely fill one of the core receiving openings 34 or 136. The blank core 114 is provided with a mounting opening 118 of suitable size and position to receive a threaded fastener 108 therein to threadedly engage the device within a slide body threaded opening 110 or 142. It is noteworthy that the blank core 114 includes a planar bottom 120 without a forward locking edge such as the locking edges 82 provided in the functional cores 36. By provided the planar bottom 120, the blank core 114 can be configured to ride directly over the hook 46 of its longitudinally aligned lever 42 whereby the hook 46 will not engage any portion of the blank core 114. In this manner, any one or more of the core receiving openings 34 can be effectively blanked without requiring any additional internal adjustments, corrections or changes in the remainder of the mechanism.

Figure 21:
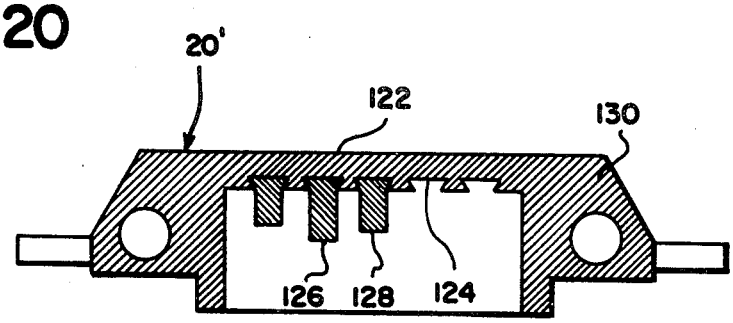
FIG. 21 is a partial, cross sectional view of a modified bridge showing replaceable, individual coin cams.

In FIG. 21 there is illustrated a cross sectional view of a modified bridge 20' wherein the bridge roof 122 is provided with a plurality of longitudinal grooves 124 of irregular configuration, for example trapezoidal in shape. It is contemplated that interchangeable, shaped cams 126, 128 will be a sliding, interchangeable fit within the respective grooves 124 to thereby change a single bridge 20' to accommodate any predetermined size of coin. Accordingly, while the bridge illustrated in FIGS. 16 and 17 could only be employed with a predetermined arrangement and denomination of coins, the modified bridge 20' of FIG. 21 could be employed with a great variety of arrangements of coins. In the case of permanently configured bridges 20 as in FIGS. 16 and 17, it would be necessary to provide a separate bridge with specifically designed cams 68, 70, 72, 74 and 76 for a desired arrangement and price. Accordingly, one bridge design would be necessary to accept five coins totaling $1.10 and an entirely different bridge design 20 would be required to accept five coins totaling $1.25. However, in the case of the modified bridge 20' of FIG. 21, a single bridge body 130 will be provided with a plurality of longitudinally extending grooves 124. Then, depending on the denomination and number of the coins to be employed, separate, particularly sized cams 126, 128 will be inserted into the grooves 124 until the desired arrangement and configuration can be achieved.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. In a coin slide of the type including a body adapted to be mounted to function a vending machine, the combination of a slide movable relative to the body between a coin receiving position and a vending position,
the slide being provided with a plurality of longitudinally aligned core openings;

a plurality of core means respectively secured in the core openings,
at least some of said core means being provided with coin receiving openings,
said coin receiving openings being respectively sized to receive and pass therethrough a coin of predetermined size; and means to interchange a core means secured within a core opening, said means to interchange comprising a removable fastener interconnecting the core means to the slide, the core means provided with a coin receiving opening being also provided with a locking edge, the locking edge being adapted to be engaged as the slide is moved from its coin receiving position to its vending position.

2. In a coin slide of the type including a body adapted to be mounted to function a vending machine, the combination of a slide movable relative to the body between a coin receiving position and a vending position,
the slide being provided with a plurality of longitudinally aligned core openings;

a plurality of core means respectively secured in the core openings,
at least some of said core means being provided with coin receiving openings,
said coin receiving openings being respectively sized to receive and pass therethrough a coin of predetermined size;

means to interchange a core means secured within a core opening, said means to interchange comprising a removable fastener interconnecting the core means to the slide; and a lever checking mechanism secured to the body in position to register with the slide as the slide moves toward its said vending position, the lever checking mechanism being provided with a plurality of coin slots to partially receive coins therein, the coin slots being respectively in longitudinal alignment with the said coin receiving openings.

3. The coin slide of claim 2 and a bridge overfitting the lever checking mechanism, the bridge comprising a body and cam means secured in the body in longitudinal alignment with the coin slots, the cam means being adapted to urge coins in the core means downwardly into the coin slots for coin checking procedures.

4. The coin slide of claim 3 and levers pivotal relative to the body, at least some of said levers being respectively aligned with a core means in a position to be contacted by a coin as the slide is moved toward its said vending position.

5. In a coin slide of the type including a body adapted to be mounted to function a vending machine, the combination of a slide movable relative to the body between a coin receiving position and a vending position,
the slide being provided with a plurality of longitudinally aligned core openings;

a plurality of core means respectively secured in the core openings,
at least some of said core means being provided with coin receiving openings,
said coin receiving openings being respectively sized to receive and pass therethrough a coin of predetermined size;
means to interchange a core means secured within a core opening, said means to interchange comprising a removable fastener interconnecting the core means to the slide; and a plurality of levers pivotal relative to the body and longitudinally aligned with a core means, the levers including hooks, each hook being urged away from contact with its associated, longitudinally aligned core means by a coin positioned within the coin receiving opening of the core means.

6. The coin slide of claim 3 wherein the bridge includes cam means of different sizes to urge downwardly coins of different sizes.

7. The coin slide of claim 3 or 6 wherein at least some of the cam means are removable and replaceable in the said bridge body.

8. In a coin slide, the combination of a body including a flange intermediate its ends, the flange being provided with a slide opening and coin receiving openings;

a slide movable relative to the body between a coin receiving position and a vending position,
the slide being provided with a plurality of longitudinally aligned, transversely spaced core receiving openings;

a plurality of interchangeable cores respectively attached in said core receiving openings and being movable as the slide is moved,
at least some of the interchangeable cores being provided with coin openings to receive coins therein;

a lever checking mechanism secured to the body rearwardly of the flange,
the lever checking mechanism comprising a pivotal lever in alignment with each said interchangeable core,
the lever including a hook adapted to engage its longitudinally aligned core in the absence of a properly sized coin being present in a said coin opening; and a bridge overfitting the lever checking mechanism and being secured to the body,
the bridge being equipped with a body and with a plurality of cam means extending from the body respectively in alignment with the coin openings in the cores to urge the coins downwardly upon their aligned levers as the slide is urged toward the vending position,
whereby the hooks of the levers are pivoted away from contact with interchangeable cores by the action of properly sized coins as the slide is moved.

9. The coin slide of claim 8 wherein some of the interchangeable cores comprise no coin opening therethrough.

10. The coin slide of claim 8 or 9 wherein the interchangeable cores having coin openings also comprise a rearwardly facing locking edge.

11. The coin slide of claim 8 wherein the interchangeable cores having coin openings also comprise a locking edge, and wherein the locking edge is positioned to be engaged by a lever hook as the slide is moved toward its said vending position.

12. The coin slide of claim 9 wherein the interchangeable cores having no coin openings have no portion thereof positioned to be engaged by a lever hook as the slide is moved toward its said vending position.

13. The coin slide of claim 8 and means to easily interchange a core within one of said core receiving openings.

14. The coin slide of claim 13 wherein the means to easily interchange a core comprises a single fastener to interconnect the core to the slide.

15. The coin slide of claim 14 wherein the fastener is threaded and the slide includes a threaded opening to removably receive the fastener.

16. The coin slide of claim 13 wherein the means to easily interchange a core is accessible when the slide is moved to its said vending position.

17. The coin slide of claim 16 and wherein the means to easily interchange a core is inaccessible when the slide is not in its said vending position.

18. The coin slide of claim 8 wherein at least some of the bridge cam means are of different sizes to urge coins of different sizes.

19. The coin slide of claim 8 wherein at least some of the bridge cam means are replaceable relative to the bridge body to permit interchange when different coins are to be used.

20. The coin slide of claim 8 wherein the lever checking mechanism terminates rearwardly in a trailing edge and wherein coins within the coin openings are adapted to exit from the interchangeable cores rearwardly of the said trailing edge.

21. The coin slide of claim 20 wherein the trailing edge is not linear.

22. The coin slide of claim 20 wherein the trailing edge is provided with at least one coin drop notch, the coin drop notch being in longitudinal alignment with one of said coin openings.

23. The coin slide of claim 8 or 22 wherein the bridge comprises a second cam surface, said second cam surface being spaced rearwardly from said cam means to urge coins downwardly rearwardly of the lever checking mechanism.

24. The coin slide of claim 22 wherein the trailing edge is provided with a coin drop notch in alignment with one said coin opening and the bridge comprises a second cam surface and wherein the second cam surface is provided with at least one longitudinally aligned undercut, the undercut receiving and urging a coin therein.

25. The coin slide of claim 24 wherein the undercut vertically registers above said one coin drop notch to urge a coin downwardly immediately rearwardly of the notch.

26. The coin slide of claim 8 wherein coins are positioned in each of the coin openings in the cores and means rearwardly of the lever checking mechanism to release the coins from association with the lever checking mechanism.

27. The coin slide of claim 26 wherein the means to release includes means to delay release of some of the coins relative to others to prevent jamming.

28. The coin slide of claim 27 wherein the means to delay comprises a first portion of the lever checking mechanism trailing edge extending rearwardly further than a second portion of the said trailing edge.

29. The coin slide of claim 28 wherein the said second portion comprises a notch, the notch being in longitudinal alignment with a coin opening.

30. The coin slide of claim 8 wherein the slide further comprises a core storage area in longitudinal, spaced relationship to the said core openings, the storage area being provided with a second plurality of core receiving openings.

* * * * *